US006660705B1

(12) United States Patent
Traber et al.

(10) Patent No.: US 6,660,705 B1
(45) Date of Patent: Dec. 9, 2003

(54) LIQUID FLUORESCENT WHITENING AGENT FORMULATION

(75) Inventors: Rainer Hans Traber, Reinach (DE); Helena Dbaly, Muttenz (CH); Josef Zelger, Riehen (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 86 days.

(21) Appl. No.: 10/049,547

(22) PCT Filed: Aug. 8, 2000

(86) PCT No.: PCT/EP00/07700

§ 371 (c)(1),
(2), (4) Date: Feb. 13, 2002

(87) PCT Pub. No.: WO01/12771

PCT Pub. Date: Feb. 22, 2001

(30) Foreign Application Priority Data

Aug. 16, 1999 (EP) ..... 99810734

(51) Int. Cl.[7] ..... C11D 9/44
(52) U.S. Cl. ..... 510/325
(58) Field of Search ..... 510/325

(56) References Cited

U.S. PATENT DOCUMENTS

| | | | | | |
|---|---|---|---|---|---|
| 5,714,450 | A | * | 2/1998 | Brouwer | 510/324 |
| 6,080,711 | A | * | 6/2000 | Brouwer et al. | 510/324 |
| 6,133,215 | A | * | 10/2000 | Zelger et al. | 510/236 |

FOREIGN PATENT DOCUMENTS

| | | |
|---|---|---|
| EP | 0837124 | 4/1998 |
| EP | 0900783 | 3/1999 |
| GB | 2041026 | 9/1980 |
| GB | 2076011 | 11/1981 |

* cited by examiner

*Primary Examiner*—John Hardee
(74) *Attorney, Agent, or Firm*—Kevin T. Mausfield

(57) ABSTRACT

A liquid fluorescent whitening agent formulation comprising: a) 10 to 20% of a compound of formula (1) in which $R_1$represents hydrogen, 1–5 C-alkyl, 1–5 C-alkoxy or halogen, M represents hydrogen, an alkaline- or alkaline earth-metal, or ammonium; b) 20 to 50% of a non-ionic surfactant; c) 20 to 40% of a polyhydroxy compound; d) 0 to 20% of a glycol compound and e) 1 to 50% water and use thereof for improving the whiteness aspect of detergents.

13 Claims, No Drawings

LIQUID FLUORESCENT WHITENING AGENT FORMULATION

The present invention provides a liquid formulation of a distyrylbiphenyl fluorescent whitening agent of the formula (1)

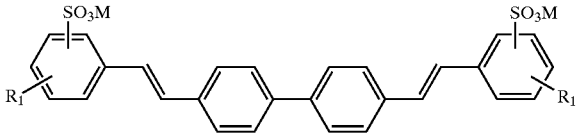

for imparting a particularly white aspect to detergent compositions.

As normally manufactured, compounds of Formula (1) have a yellowish tinge which, depending upon the method of manufacture, can impart an undesirable discolouration to the finished detergent.

Surprisingly, it has now been found that a specific formulation of compound (1) is able to overcome this disadvantage.

Accordingly, the present invention describes a liquid fluorescent whitening agent formulation comprising:

a) 10 to 20% of a compound of Formula (1) in which $R_1$ represents hydrogen, 1–5 C-alkyl, 1–5 C-alkoxy or halogen, M represents hydrogen, an alkaline- or alkaline earth-metal, or ammonium;

b) 20 to 50% of a non-ionic surfactant;

c) 20 to 40% of a polyhydroxy compound;

d) 0 to 20% of a glycol compound and e) 1 to 50% water.

Preferably, the optical whitening agent is of the formula is ethoxylated with between 3 and 20 moles of ethylene oxide being most preferred, whereby a $C_{13}$-fatty acid alcohol which is ethoxylated with 9 moles of ethylene oxide (Marlipal 013/90) being the component of choice.

The polyhydroxy compound, component c) of the formulation is, preferably, a triol such as 1,2,6-hexanetriol, glycerine or an oligomer of glycerine such as a di-, tri- or polyglycerine, glycerine being most preferred.

The glycol compound, component d) of the formulation is, for example, ethylene glycol, diethylene glycol, propylene glycol or hexylene glycol, the hexylene glycol 2-methyl-2,4-pentanediol and 1,2-propylene glycol being preferred.

A preferred formulation comprises a) 10 to 20% of the compound of formula (2);

b) 20 to 50% of a $C_{11}$–$C_{13}$fatty acid alcohol which is ethoxylated with between 3 and 20 moles of ethylene oxide;

c) 20 to 40% of glycerine;

d) 0 to 20% of ethylene glycol, 1,2-propylene glycol or 2-methyl-2,4-pentanediol and e) 1 to 50% of water, whereby a formulation comprising a) 10 to 20% of the compound of formula (2);

b) 20 to 50% of a $C_{13}$-fatty acid alcohol which is ethoxylated with 9 moles of ethylene oxide;

c) 20 to 40% of glycerine;

d) 5 to 20% of 1,2-propylene glycol or 2-methyl-2,4-pentanediol and e) 10 to 40% of water is particularly preferred.

When, in formula (1), $R_1$ represents 1–5 C-alkyl, these may be methyl, ethyl, n- or isopropyl, n-, sec-, or t-butyl, n-pentyl, iso-amyl or sec-amyl groups. When, in formula (1), $R_1$ represents 1–5 C-alkoxy, these may be methoxy, ethoxy, n- or isopropoxy, n-, sec-, or t-butoxy, n-pentyloxy, (2)

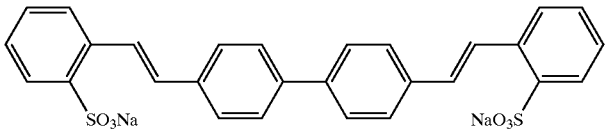

, (3)

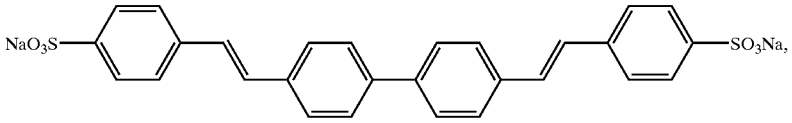

(4)

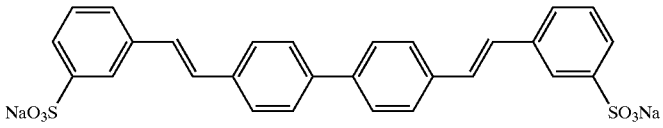

or (5)

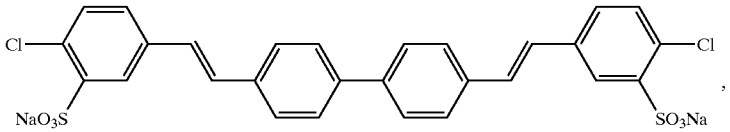

, the compound of formula (2) being most preferred.

The non-ionic surfactant, component b) of the formulation is preferably an alkoxylated fatty acid alcohol, especially ethoxylated and is, more preferably, a $C_8$–$C_{18}$-fatty acid alcohol which is ethoxylated with between 3 and 20 moles of ethylene oxide, a $C_{11}$–$C_{13}$-fatty acid alcohol which iso-amyloxy or sec-amyloxy groups. When, in formula (1), $R_1$ represents halogen, these may be fluorine, chlorine, bromine, or iodine, preferably chlorine.

Optional auxiliaries which may be present in the formulation of the present invention include stabilisers which are effective in adjusting the flow properties of the formulation, anti-foam agents, alkaline agents, fabric softeners, anti-redeposition agents, antioxidants, auxiliary builders such as polyacrylic acid and fragrances.

Examples of such stabilisers include, e.g., kaolin, an Mg/Al silicate, especially bentonite, montmorillonite, a zeolite or a highly dispersed silicic acid.

The formulation of the present invention may be produced by mixing the components a) to e) together with any optional auxiliaries, and homogenising the mixture so obtained, preferably at an elevated temperature, e.g. at 40–100° C. Mixing is conveniently effected by a suitable stirring device.

The resulting formulation is normally a clear and stable solution. On occasion, however, it may be necessary to filter the formulation in order to remove minor amounts of insoluble components.

The formulation of the present invention is particularly suitable for incorporation into a dry detergent composition, conveniently by adding the required amount of the formulation of the present invention to a dry detergent composition and then homogenising the mixture so obtained. The formulation of the present invention may also be used, however, for the production of liquid detergents by adding the required amount of the formulation of the present invention to a liquid detergent composition and then homogenising the mixture so obtained. The liquid formulation of the invention is also characterized by its excellent stability under cold storage conditions.

The following Examples further illustrate the present invention. Parts and percentages shown therein are by weight unless otherwise stated.

EXAMPLE 1

A reaction vessel equipped with stirrer and heating bath is charged with 29 g. of a $C_{13}$-fatty acid alcohol ethoxylated with 9 moles of ethylene oxide, 30 g. of glycerine, 8 g. of 2-methyl-2,4-pentanediol and 3 g. of water. The stirred mixture is heated to 50° C. and 30 g. of a moist filter cake containing 50% of the compound of Formula (2) added over 1 hour. The mixture was then cooled to room temperature and clarified by filtration to yield a formulation containing:

15% of the compound of Formula (2),

29% of a $C_{13}$-fatty acid alcohol ethoxylated with 9 moles of ethylene oxide, 30% of glycerine, 8% of 2-methyl-2,4-pentanediol and 18%. of water.

The resulting formulation exhibits excellent stability under cold storage conditions.

EXAMPLES 2–7

By replacing the $C_{13}$-fatty acid alcohol ethoxylated with 9 moles of ethylene oxide in Example 1 by the ethoxylated alcohols shown in the following Table 1, similar formulations of excellent cold storage stability may be obtained.

TABLE 1

| Example Nr. | Alcohol | Ethylene Oxide |
|---|---|---|
| 2 | $C_{14}$ | 9 moles |
| 3 | $C_{13}$ | 17 moles |
| 4 | $C_{10}$ | 6 moles |
| 5 | $C_{10}$ | 7 moles |
| 6 | $C_{10}$ | 8 moles |
| 7 | $C_{10}$ | 11 moles |

What is claimed is:

1. A liquid fluorescent whitening agent formulation comprising:

a) 10 to 20% of a compound of formula (1)

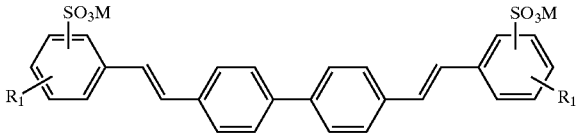

in which $R_1$ represents hydrogen, 1–5 C-alkyl, 1–5 C-alkoxy or halogen, M represents hydrogen, an alkaline- or alkaline earth-metal, or ammonium;

b) 20 to 50% of a non-ionic surfactant;

c) 20 to 40% of a polyhydroxy compound;

d) 0 to 20% of a glycol compound and e) 1 to 50% water.

2. A formulation according to claim 1 in which the compound of formula (1) is (2)

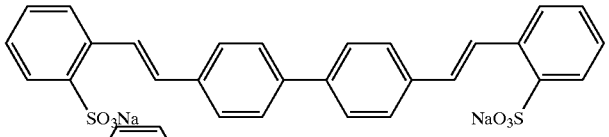

, (3)

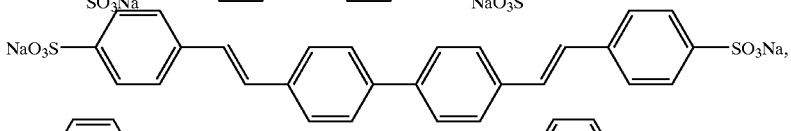

(4)

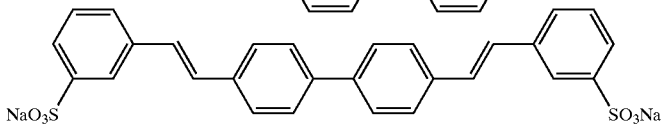

or (5)

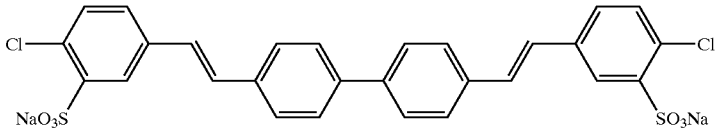

.

3. A formulation according to claim 1 in which component a) is the compound of formula (2).

4. A formulation according to claim 1 in which component b) is an alkoxylated fatty acid alcohol.

5. A formulation according to claim 4 in which component b) is a $C_8$–$C_{18}$-fatty acid alcohol which is ethoxylated with between 3 and 20 moles of ethylene oxide.

6. A formulation according to claim 4 which component b) is a $C_{11}$–$C_{13}$-fatty acid alcohol which is ethoxylated with between 3 and 20 moles of ethylene oxide.

7. A formulation according to claim 1 in which the polyhydroxy compound c) is a triol, glycerin or an oligomer of glycerin.

8. A formulation according to claim 7 in which the triol is 1,2,6-hexanetriol or the oligomer of glycerin is a di-, tri- or polyglycerin.

9. A formulation according to claim 1 in which the glycol component d) is ethylene glycol, diethylene glycol, propylene glycol or hexylene glycol.

10. A formulation according to claim 1 comprising a) 10 to 20% of the compound of formula (2)

(2)

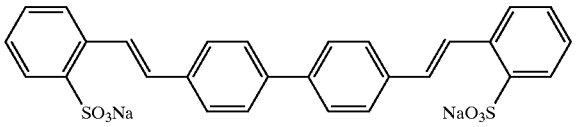

;

b) 20 to 50% of a $C_{11}$–$C_{13}$fatty acid alcohol which is ethoxylated with between 3 and 20 moles of ethylene oxide;

c) 20 to 40% of glycerin;

d) 0 to 20% of ethylene glycol, 1,2-propylene glycol or 2-methyl-2,4-pentanediol and e) 1 to 50% of water.

11. A formulation according to claim 10 comprising a) 10 to 20% of the compound of formula (2);

b) 20 to 50% of a $C_{13}$-fatty acid alcohol which is ethoxylated with 9 moles of ethylene oxide;

c) 20 to 40% of glycerine;

d) 5 to 20% of 1,2-propylene glycol or 2-methyl-2,4-pentanediol and e) 10 to 40% of water.

12. A method of improving the whiteness aspect of a detergent which comprises incorporating therein a formulation according to claim 10.

13. A method of improving the whiteness aspect of a detergent which comprises incorporating therein a formulation according to claim 1.

* * * * *